US011370639B2

(12) United States Patent
Williams et al.

(10) Patent No.: US 11,370,639 B2
(45) Date of Patent: Jun. 28, 2022

(54) EMERGENCY ELEVATOR EVACUATION SYSTEM

(71) Applicants: Jessica Williams, Center City, MN (US); Wanda Deaton, Oswego, IL (US)

(72) Inventors: Jessica Williams, Center City, MN (US); Wanda Deaton, Oswego, IL (US)

(73) Assignees: Jessica Williams, Center City, MN (US); Wanda Deaton, Oswego, IL (US)

( * ) Notice: Subject to any disclaimer, the term of this patent is extended or adjusted under 35 U.S.C. 154(b) by 954 days.

(21) Appl. No.: 16/134,310

(22) Filed: Sep. 18, 2018

(65) Prior Publication Data

US 2019/0084800 A1 Mar. 21, 2019

Related U.S. Application Data

(63) Continuation-in-part of application No. 15/709,783, filed on Sep. 20, 2017, now abandoned.

(51) Int. Cl.
*B66B 5/02* (2006.01)
*B66B 1/34* (2006.01)
(Continued)

(52) U.S. Cl.
CPC ..... *B66B 5/021* (2013.01); *B66B 1/28* (2013.01); *B66B 1/3461* (2013.01); *B66B 1/3476* (2013.01); *B66B 3/002* (2013.01)

(58) Field of Classification Search
CPC ..... B66B 5/021; B66B 5/02; B66B 5/0012; B66B 5/0031; B66B 5/024; B66B 3/00;
(Continued)

(56) References Cited

U.S. PATENT DOCUMENTS 5,979,607 A * 11/1999 Allen ..... B66B 5/024 187/390
8,251,185 B2 8/2012 Manabe
(Continued)

FOREIGN PATENT DOCUMENTS

CN 107879201 A * 4/2018 ..... B66B 1/2408
CN 107879202 A * 4/2018 ..... B66B 1/28
(Continued)

*Primary Examiner* — Marlon T Fletcher
(74) *Attorney, Agent, or Firm* — Kunzler Bean & Adamson

(57) ABSTRACT

The disclosure includes elevator emergency control systems and methods for use in an elevator. The elevator emergency control system may include a control station disposed external to multiple buildings. The control station may be configured to: determine that an emergency condition exists for the multiple buildings; in response to determining that the emergency condition exists for the multiple buildings, transmit a first emergency alert signal that directs a first group of elevators located in at least two buildings of the multiple building to enter an emergency mode, and the emergency mode results in the first group of elevators: traveling vertically downward with respect to a first group of structures; and answering down hall calls until the first group of elevators reaches an elevator weight capacity, an egress floor, or a combination thereof.

18 Claims, 14 Drawing Sheets

(51) Int. Cl.
*B66B 3/00* (2006.01)
*B66B 1/28* (2006.01)

(58) Field of Classification Search
CPC ..... B66B 1/2408; B66B 1/3461; B66B 3/002; B66B 5/022; B66B 5/0018; B66B 5/0006; B66B 5/025
See application file for complete search history.

(56) References Cited

U.S. PATENT DOCUMENTS

| | | | | |
|---|---|---|---|---|
| 8,839,914 | B2 | 9/2014 | Iwata et al. | |
| 10,029,884 | B2 * | 7/2018 | Youker | B66B 3/00 |
| 2015/0114763 | A1 * | 4/2015 | Kim | B66B 5/0012 187/392 |
| 2017/0355554 | A1 * | 12/2017 | Eleid | B66B 1/2458 |
| 2019/0084800 | A1 * | 3/2019 | Williams | B66B 1/3476 |

FOREIGN PATENT DOCUMENTS

| | | | | | |
|---|---|---|---|---|---|
| CN | 107879203 | A | * | 4/2018 | B66B 1/2408 |
| CN | 107879213 | A | * | 4/2018 | B66B 1/2408 |
| CN | 107879214 | A | * | 4/2018 | B66B 1/28 |
| CN | 109384114 | A | * | 2/2019 | B66B 3/002 |
| EP | 1433735 | A1 | * | 6/2004 | B66B 5/022 |
| KR | 20080013141 | A | * | 8/2006 | |
| KR | 20080087156 | A | * | 8/2008 | |
| KR | 20150093327 | A | * | 2/2014 | |
| KR | 20150127957 | A | * | 5/2014 | |
| WO | WO-2009098759 | A1 | * | 8/2009 | B66B 5/021 |
| WO | WO-2017085839 | A1 | * | 5/2017 | B66B 5/02 |

* cited by examiner

EMERGENCY ELEVATOR EVACUATION SYSTEM

CROSS-REFERENCE TO RELATED APPLICATIONS

This application claims priority to U.S. patent application Ser. No. 15/709,783 entitled "ELEVATOR CONTROL SYSTEMS AND METHODS" and filed on Sep. 20, 2017 for Jessica Williams et al., which is incorporated herein by reference in its entirety.

FIELD

The invention relates generally to elevator systems, and more specifically to emergency alerts for elevator systems.

BACKGROUND

Many buildings, taller than 30 feet in height, have elevator systems that move vertically to thereby transport passengers from floor to floor. In conventional elevator systems there is an emergency procedure that must be followed in the event of a fire. For example, during a fire the elevator system may be commandeered and operate in a manner to ensure occupant safety. While elevator systems follow detailed procedures during fire emergencies, they do not have defined procedures for other emergent events. Accordingly, there is a need for systems and methods to define and perform emergency procedures during non-fire emergent events.

BRIEF SUMMARY

The present disclosure includes an elevator emergency control system. The elevator emergency control system, in some embodiments, may include a control station disposed external to multiple buildings. In such embodiments, the control station may be configured to: determine that an emergency condition exists for the multiple buildings; in response to determining that the emergency condition exists for the multiple buildings, transmit a first emergency alert signal that directs a first group of elevators located in at least two buildings of the multiple building to enter an emergency mode, and the emergency mode results in the first group of elevators: traveling vertically downward with respect to a first group of structures; and answering down hall calls until the first group of elevators reaches an elevator weight capacity, an egress floor, or a combination thereof.

In some embodiments, one or more groups of emergency key switches are communicatively coupled to the first group of elevators, and the one or more groups of emergency key switches are configured to activate and deactivate the emergency mode in the first group of elevators. In certain embodiments, the control station is configured to receive information indicating that the emergency condition exists. In various embodiments, the control station is configured to receive information indicating that the emergency condition no longer exists. In one embodiment, the control station is configured to receive the information indicating that the emergency condition no longer exists in response to one or more groups of emergency key switches deactivating the emergency mode in the first group of elevators.

In some embodiments, the central station is configured to: transmit a second emergency alert signal that directs a second group of elevators located in at least two buildings of the multiple buildings to enter the emergency mode, the second group of elevators is different from the first group of elevators, and the emergency mode results in the second group of elevators: traveling vertically downward with respect to a second group of structures; and answering down hall calls until the second group of elevators reaches the elevator weight capacity, the egress floor, or a combination thereof.

In certain embodiments, the first group of structures are located within a first quadrant of a city and the second group of structures are located within a second quadrant of the city. In various embodiments, the first group of structures are taller than a first predetermined height and the second group of structures are shorter than the first predetermined height. In one embodiment, the emergency mode does not change operation of the first group of elevators if the first group of elevators are in an earthquake response mode.

One method for an emergency elevator evacuation system includes determining, via a control station external to multiple buildings, that an emergency condition exists for the multiple buildings. In some embodiments, the method includes, in response to determining that the emergency condition exists for the multiple buildings, transmitting, via the control station, an emergency alert signal to a first group of elevators located in at least two buildings of the multiple buildings. In such embodiments, in response to transmitting the emergency alert signal: the first group of elevators enters an emergency mode in which the first group of elevators travel vertically downward with respect to a first group of structures; and the first group of elevators answers down hall calls until the first group of elevators reaches an elevator weight capacity, an egress floor, or a combination thereof.

In certain embodiments, the method includes, in response to transmitting the emergency alert signal, the first group of elevators travels to an uppermost floor of the first group of structures and then answers the down hall calls until the first group of elevators reaches the elevator weight capacity, the egress floor, or a combination thereof. In various embodiments, in response to transmitting the emergency alert signal, the first group of elevators travels directly to the egress floor of the first group of structures in response to the first group of elevators reaching the elevator weight capacity. In some embodiments, the method includes receiving a signal that indicates that the emergency condition no longer exists in response to one or more groups of emergency key switches deactivating the emergency mode in the first group of elevators.

In one embodiment, the method includes transmitting, via the control station, the emergency alert signal to a second group of elevators located in at least two buildings of the multiple buildings. In such an embodiment, the second group of elevators is different from the first group of elevators, and transmitting the emergency alert signal to the second group of elevators directs: the second group of elevators to enter the emergency mode in which the second group of elevators travel vertically downward with respect to a second group of structures; and the second group of elevators to answer down hall calls until the second group of elevators reaches the elevator weight capacity, the egress floor, or a combination thereof. In certain embodiments, the first group of structures are located within a first quadrant of a city and the second group of structures are located within a second quadrant of the city.

One apparatus for an emergency elevator evacuation system includes a processor. In some embodiments, the apparatus includes a memory comprising code executable by the processor. In such embodiments, the code is configured to: determine that an emergency condition exists for multiple buildings external to the apparatus; in response to determining that the emergency condition exists for the multiple buildings, transmit a first emergency alert signal that directs a first group of elevators located in at least two buildings of the multiple buildings to enter an emergency mode, and the emergency mode results in the first group of elevators: traveling vertically downward with respect to a first group of structures; and answering down hall calls until the first group of elevators reaches an elevator weight capacity, an egress floor, or a combination thereof.

In various embodiments, one or more groups of emergency key switches are communicatively coupled to the first group of elevators, and the one or more groups of emergency key switches are configured to activate and deactivate the emergency mode in the first group of elevators. In some embodiments, the code is configured to receive information indicating that the emergency condition exists. In certain embodiments, the code is configured to receive information indicating that the emergency condition no longer exists. In one embodiment, the code is configured to receive information indicating that the emergency condition no longer exists in response to one or more groups of emergency key switches deactivating the emergency mode in the first group of elevators.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments. The above and other features of the present invention will become more apparent by describing in detail exemplary embodiments thereof with reference to the accompanying drawings, in which.

DETAILED DESCRIPTION

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below.

For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Because elevators are confined spaces with limited egress, elevator occupants may be vulnerable during emergent events, such as breaches of Homeland Security. Because of the vulnerable nature, elevator safety may be improved by having defined safety and emergency procedures to follow during various crisis situations. Accordingly, the systems and methods described herein may remedy the deficiencies and gaps in how current elevator systems respond to emergencies. It should be appreciated that the systems and methods disclosed herein may not interrupt fire emergency service procedures.

Figure 1:
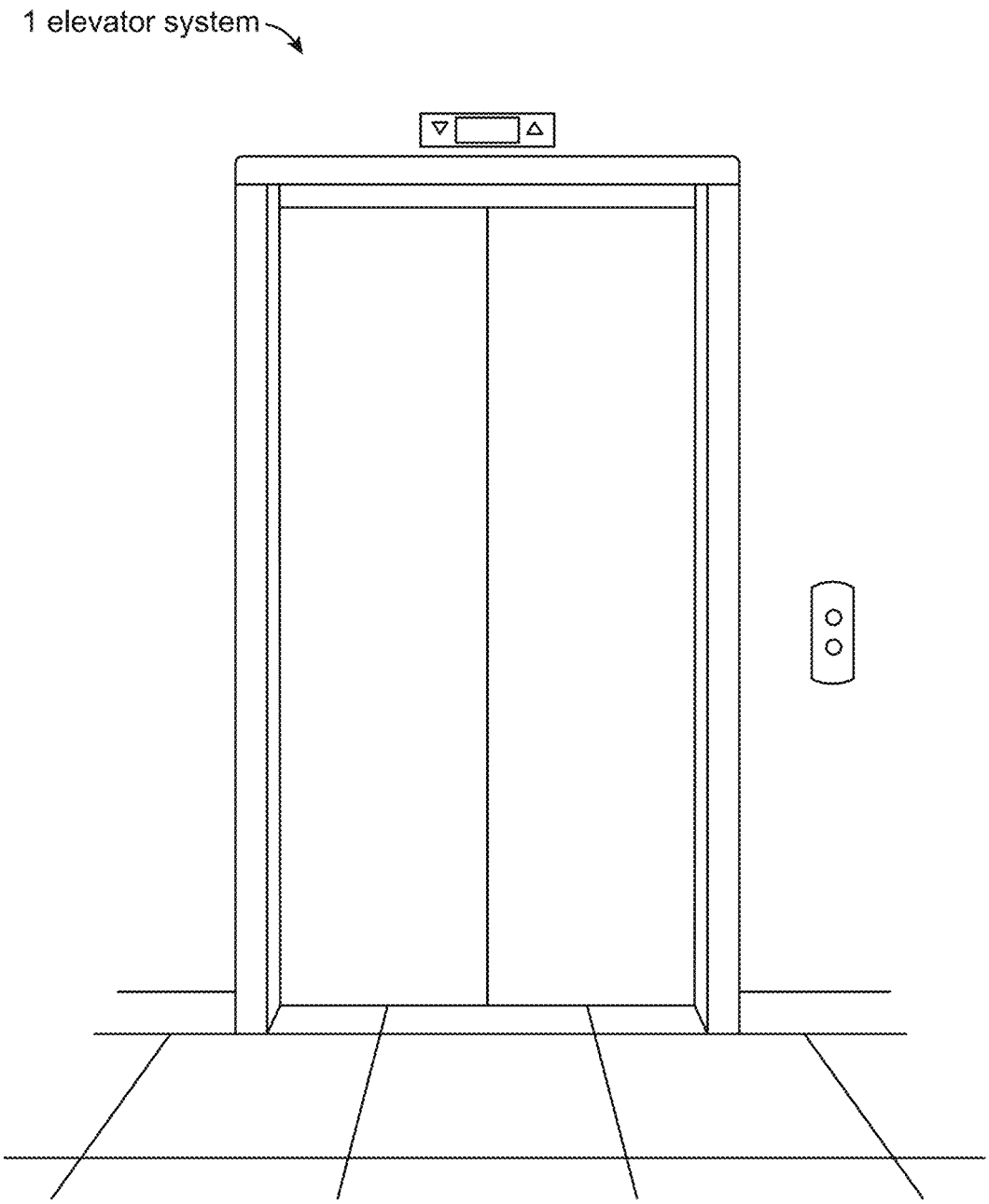
FIG. 1 (PRIOR ART)
FIG. 1 illustrates an elevator system, according to some embodiments.
Figure 2:
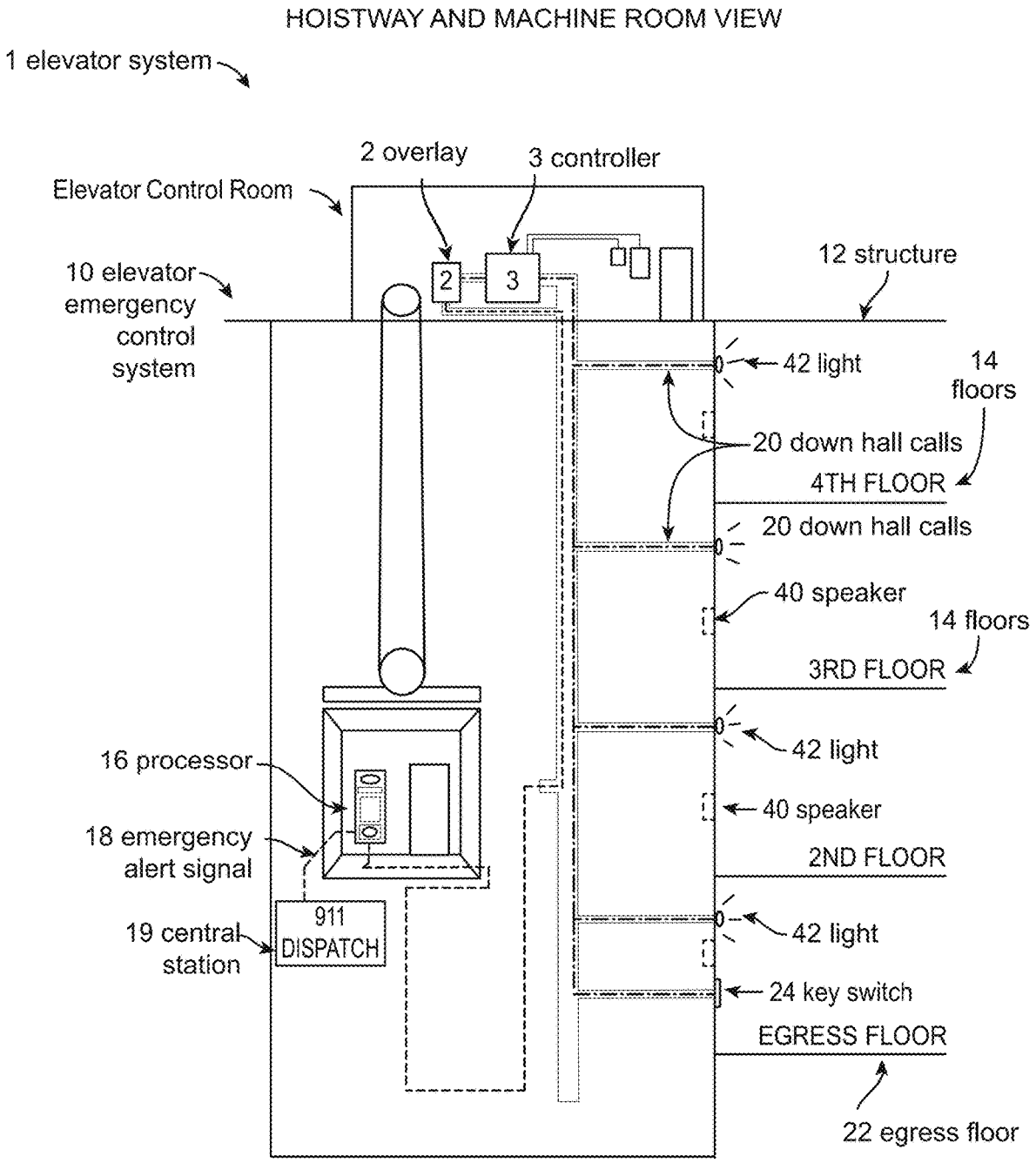
FIG. 2 illustrates an elevator emergency control system, according to some embodiments.

As shown in FIGS. 1 and 2, the disclosure includes elevator systems 1 that travel vertically within a structure 12 having two or more floors 14. Structures 12 may include buildings, factories, schools, homes, apartments, any building at least 30 feet in height, and the like.

The disclosure includes an elevator emergency control system 10 that may comprise a processor system 16 arranged and configured to receive an emergency alert signal 18. In response to receiving the emergency alert signal 18, the processor system 16 may then cause the elevator 1 to exit a normal operation mode and thereby enter an emergency mode. In the emergency mode the elevator 1 may only travel vertically downward with respect to the structure 12 whereby the elevator 1 answers down hall calls 20 until the elevator 1 reaches its weight capacity and/or an egress floor 22 (e.g. a floor having an exit to the outside of the structure). A down hall calls occur when someone pushes a down button located adjacent an elevator shaft (or the elevator doorframe) to call (or summons) the elevator for a ride. It should be appreciated that when the elevator 1 is in the normal operation mode, as the name implies the elevator 1 travels in both the upward and downward vertical directions to answer up and down hall calls.

The elevator emergency control system 10 may enter and exit the emergency mode in response to a variety of inputs. In many embodiments, the elevator emergency control system 10 enters the emergency mode in response to receiving an emergency alert signal from a 911-dispatcher. The emergency alert signal 18 may comprise a phone call, text message, email, and/or any type of communication sent by a 911-dispatcher via a telephone line, cellular connection, Wi-Fi connection, or the like.

In some embodiments, the 911-dispatcher sends an alert to an elevator 1 located in one specific structure 12 or a group of elevators 1 located in a group of structures 12 located in an area, such as a specific neighborhood or quadrant of the city. It should be appreciated that neighborhoods or quadrants can be partitioned into any such manner, for example, by acreage, number of city blocks, location with respect to a landmark, a radius from a specific location, and the like. Even still, in some embodiments, the 911 dispatcher, such as a central station 19 (e.g., control station), sends the emergency alert signal 18 to all elevators 1 taller than a specified height located within a defined area. It should also be appreciated that the central station 19 may control one elevator 1, one group of elevators 1, or any number of elevators 1, such as a first group of elevators 1*a* and a second group of elevators 1*b* simultaneously. In this regard, the central station 19 may send a first emergency alert signal 18*a* to a first group of elevators 1*a* and a second emergency alert signal 18*b* to a second group of elevators 1*b*. It should be appreciated that the central station 19 is remotely located with respect to the group of elevators 1 and group of structures 12 (e.g., group of buildings). For example, the central station 19, in some embodiments, is located (e.g., disposed) external to multiple buildings or groups of buildings (e.g., multiple groups of structures 12).

Figure 3:
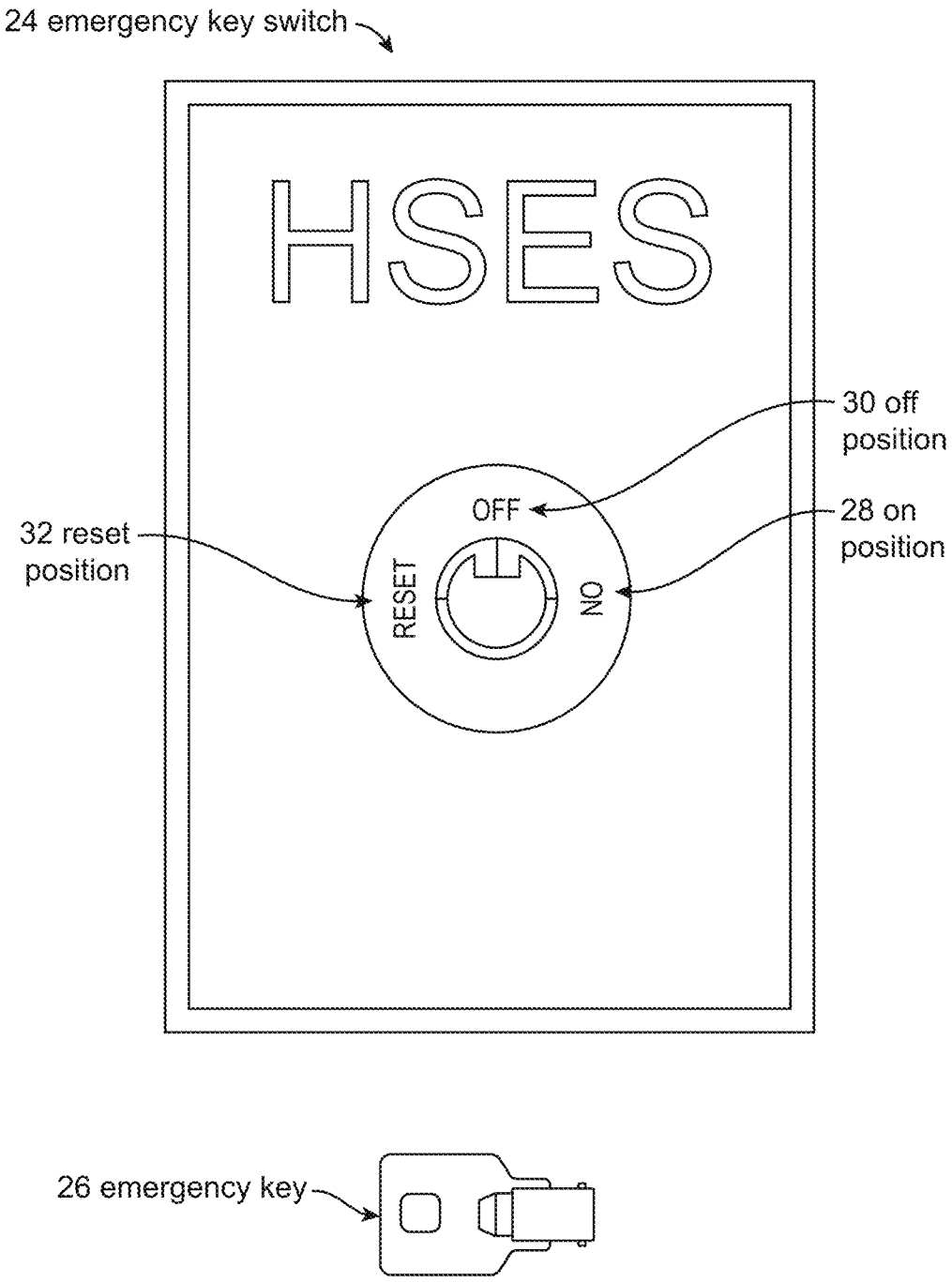
FIG. 3 illustrates an emergency key switch, according to some embodiments.

Furthermore, the elevator emergency control system 10 may also be activated and deactivated in response to various triggers. For example, as shown in FIGS. 2 and 3, the system 10 may include an emergency key switch 24 communicatively coupled to the processor system 16. The emergency key switch 24 may be configured to activate and deactivate the emergency mode. Accordingly, in some embodiments, the system 10 further includes an emergency key 26 configured to activate and deactivate the emergency key switch 24. As such, the system 10 may be activated (i.e. the system 10 enters the emergency mode) in response to the key 26 turning the key switch 24 to an on position 28. Additionally, the system 10 may be deactivated (i.e. the system 10 exits the emergency mode) in response to the key 26 turning the key switch 24 to an off position 30 or a reset position 32. The emergency key switch 24 may be located on the egress floor 22 of the structure 12. In some embodiments, the system 10 can only be deactivated (e.g. exit the emergency mode and enter normal operation mode) by a certified elevator operator or technician. In certain embodiments, elevators 1*a* and 1*b* will end operations at the egress floor in response to receiving the emergency alert signal. At the egress floor, the elevators 1*a* and 1*b* may remain with their doors open until the emergency key switch 24 is used to deactivate the emergency mode. However, in some embodiments, the system 10 is arranged and configured to deactivate in response to other inputs, such as a 911-dispatcher sending a transmission to the system 10 indicating that the emergency has ended.

According to FIG. 2, the elevator emergency control system 10 may also include numerous components to provide audible and visible warnings to people located near the elevator shaft on different floors 14 of the structure 12. For example, the system 10 may include a speaker 40 coupled to the structure 12 and communicatively coupled to the processor system 16 whereby the speaker 40 is configured to emit a message in response to the elevator 1 entering the emergency mode. For example, in some embodiments, the message states, "There is an emergency. You must evacuate the building immediately." However, it should be appreciated that the message may be any type of live or prerecorded message including a notification of the emergency situation.

The system 10 may also include a light 42 coupled to the structure and communicatively coupled to the processor system 16. The light 42 may be configured to illuminate in response to the elevator 1 entering the emergency mode. In some embodiments, the light 42 is a strobe light comprising a green color. Generally speaking, the system may implement any type of light 42 configured to attract the attention of building occupants.

Figure 4:
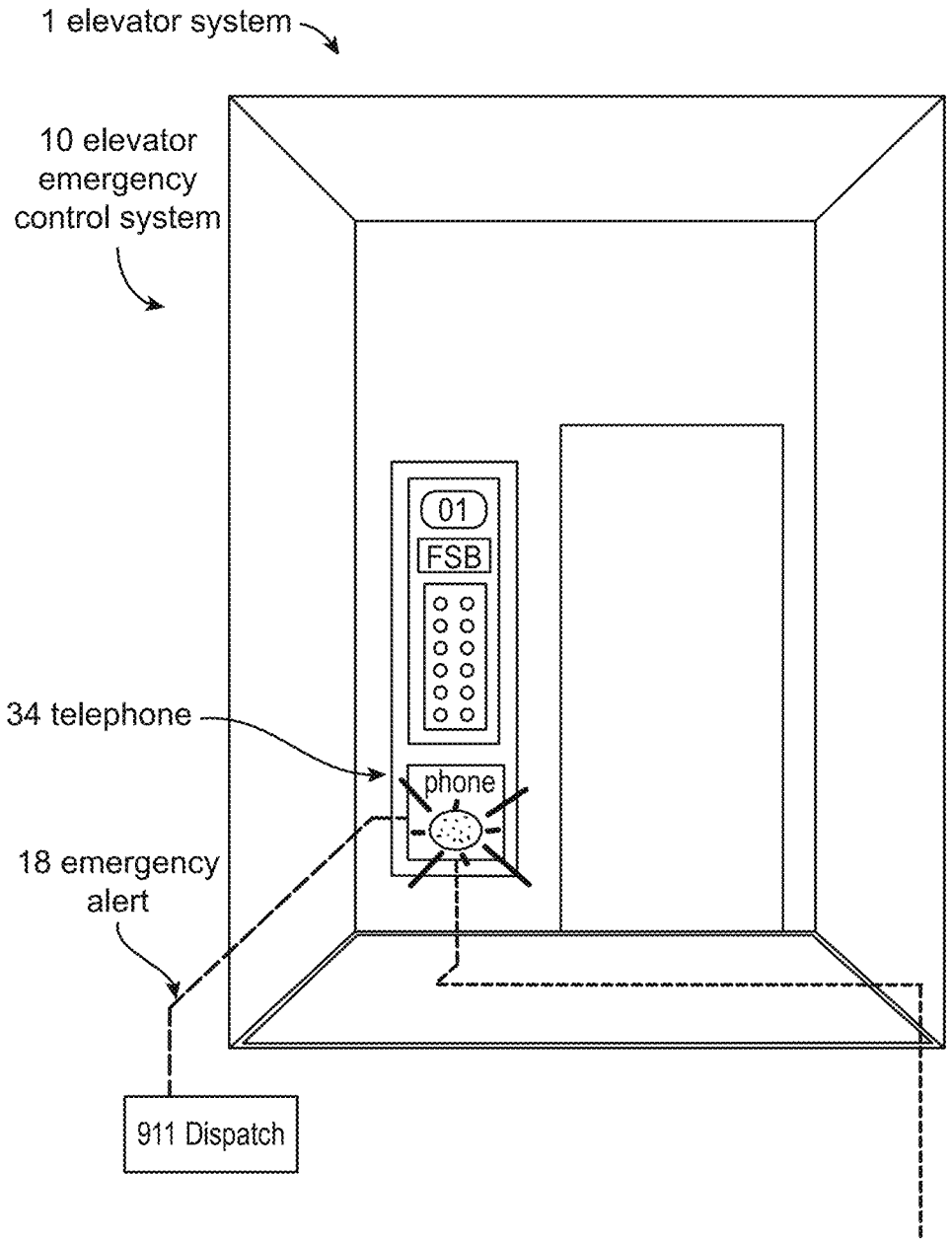
FIGS. 4 and 5 illustrate elevator systems, according to some embodiments.
Figure 5:
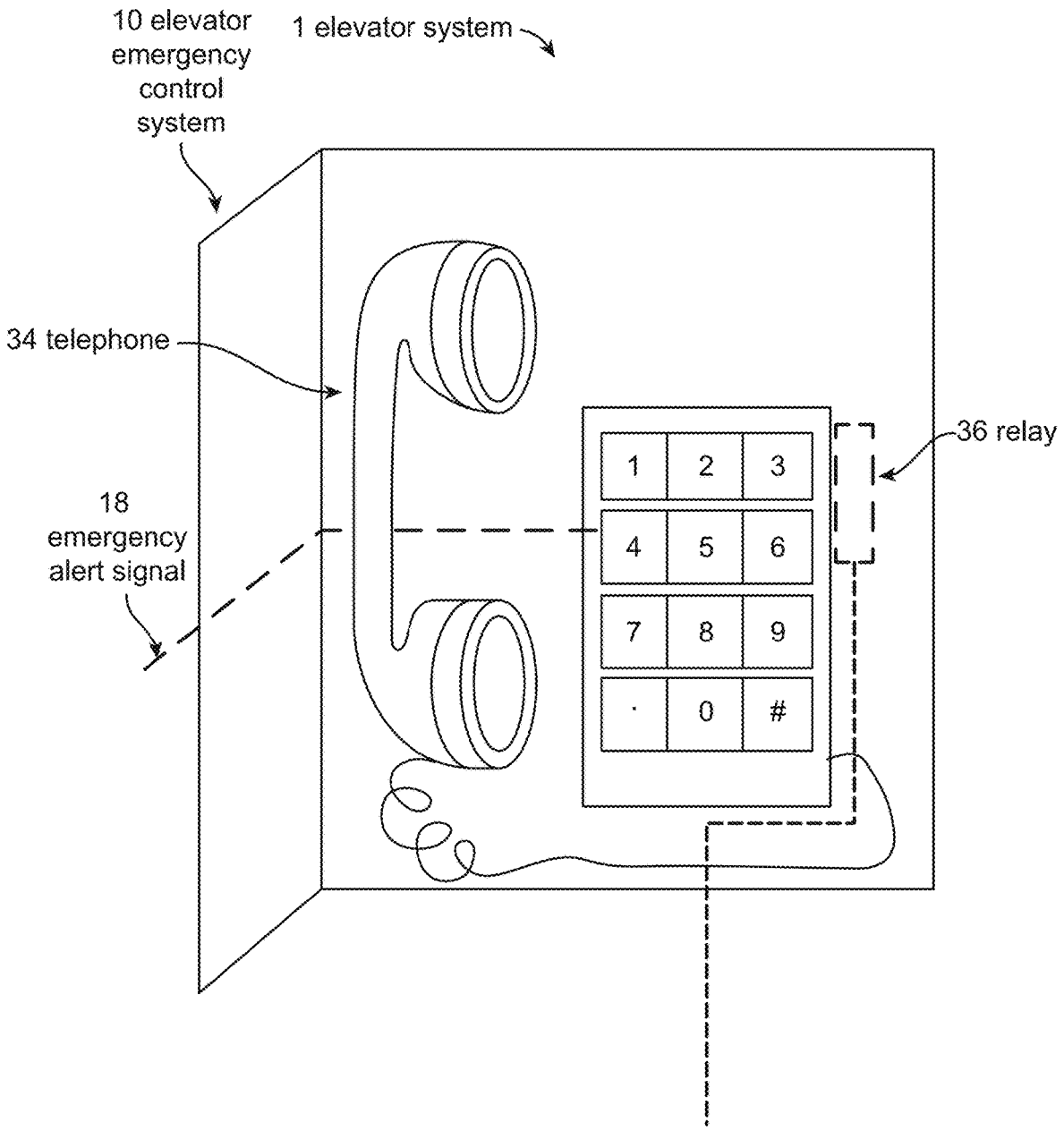

Now with reference to FIGS. 4 and 5, the elevator emergency control system 10 may also include a telephone 34 coupled to the elevator 1. According to FIG. 4, the emergency alert signal 18 may be sent by the 911-dispatcher and/or other emergency service personnel to the telephone 34 and/or relay 36. As shown in FIG. 5, the system 10 may include a relay 36 that sends the elevator 1 into the emergency mode in response to the relay 36 receiving the emergency alert signal 18.

Figure 6:
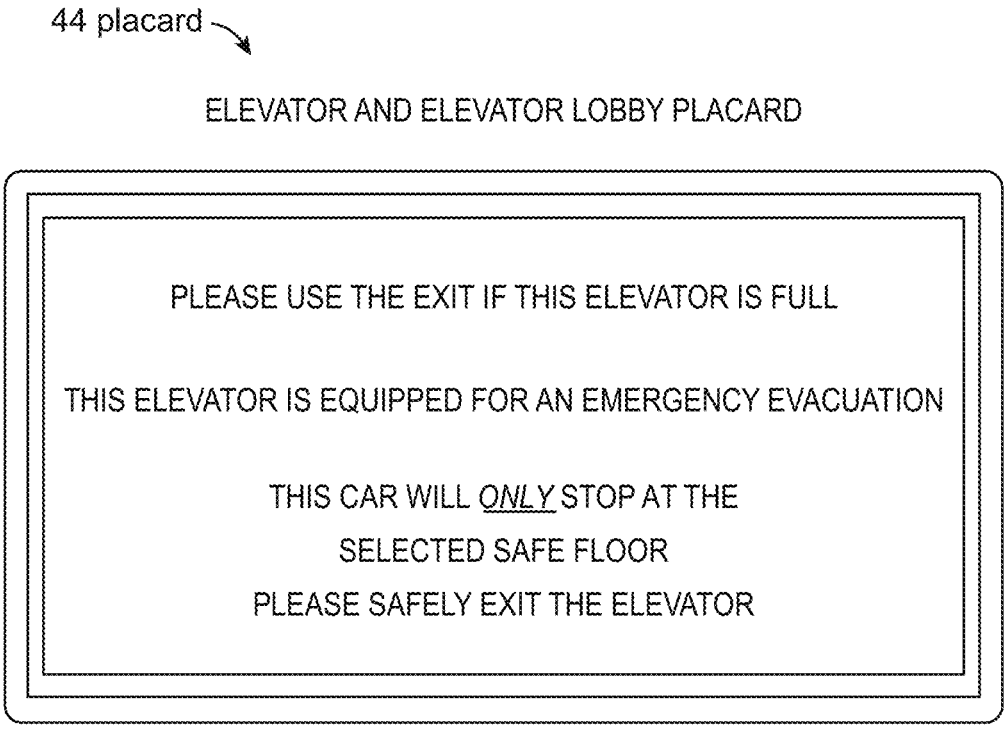
FIG. 6 illustrates an elevator placard, according to some embodiments.

As illustrated in FIG. 6, embodiments may also include a warning placard 44 located inside the elevator 1 and on every floor by the elevator doorframes and/or the elevator shafts. The warning placard 44 may include any such message to inform people that there is an emergency evacuation system in place and the elevator will assist to evacuate the building. The warning placard 44 may include a digital display. Accordingly, the warning placard 44 may be changed electronically to show different digital messages as desired. In some embodiments, the warning placard 44 states:

"Please use the exit if this elevator is full"

"This elevator is equipped for an emergency evacuation"

"This car will only stop at the selected safe floor"

"Please safely exit the elevator"

Figure 7:
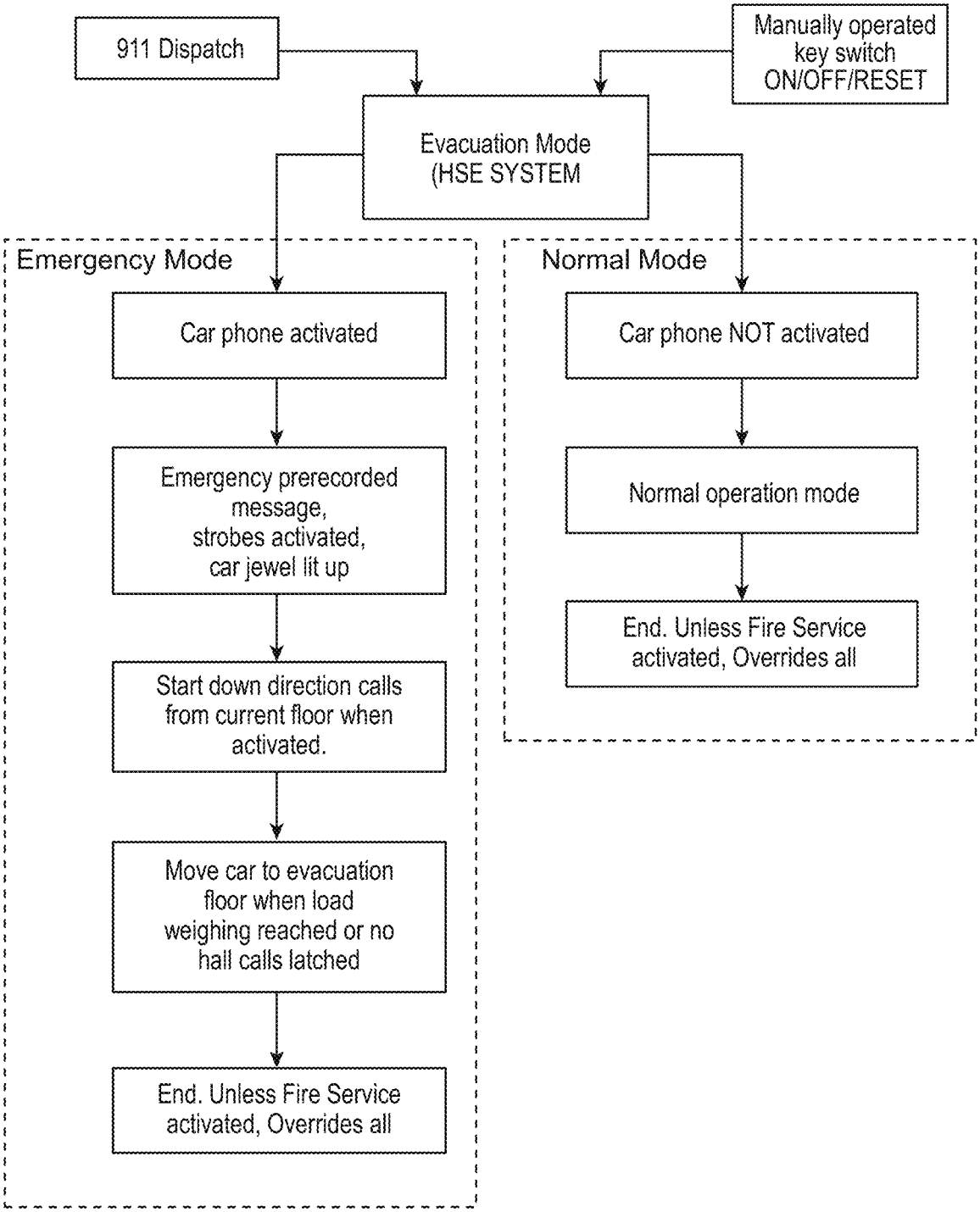
FIGS. 7, 8, 9, and 10 illustrate flow charts for controlling an elevator during an emergency, according to some embodiments.

The disclosure also includes methods for controlling an elevator system 1 during an emergency situation. As shown in FIG. 7, the elevator emergency control system 10 may be activated by a 911 dispatch, such as an emergency alert signal 18 and/or a transmission an emergency service personnel. The alert signal 18 may trigger the elevator system 1 to enter the emergency mode whereby the elevator car telephone 34 is activated, an indicator light 42 is illuminated, and a pre-recorded message(s) is emitted from a speaker 40 in the elevator 1 or elsewhere in the structure 12.

In certain embodiments, such as in certain elevator models, the elevator emergency control system 10 may enter the emergency mode in response to the relay 36 sending a signal through a traveler that hangs under the elevator 1 and goes through a metal raceway up into a machine room to an overlay system, which in return activates controls specific to the functions of the elevator emergency control system 10 to thereby enter the emergency mode. Accordingly, the elevator 1 may thereby start moving in a vertically downward direction, only answering down hall calls, until the elevator reaches the egress floor 22 and/or a maximum weight capacity. Once the elevator 1 reaches the egress floor 22 and stops to unload passengers, the elevator 1 may then travel back to the highest floor having a down hall call. In some embodiments, the elevator 1 ignores up hall calls and bypasses the floor where the up hall call originated. However, in some embodiments, the elevator 1 stops at floors where up hall calls originated to retrieve passengers and then only travels in a downward direction to the egress floor 22 to bring the passengers to safety.

The elevator 1 may proceed in the emergency mode until all down hall calls have been answered, the emergency mode has been deactivated by the key switch 24, or emergency fire service has been activated. As previously discussed, because of fire code, the emergency fire service may override the emergency mode described herein. Furthermore, in the absence of the elevator emergency control system 10 receiving an emergency notification (e.g. an emergency alert signal 18 and/or an activation from the emergency key switch 24) the elevator 1 will continue to operate in normal operation mode.

Figure 8:
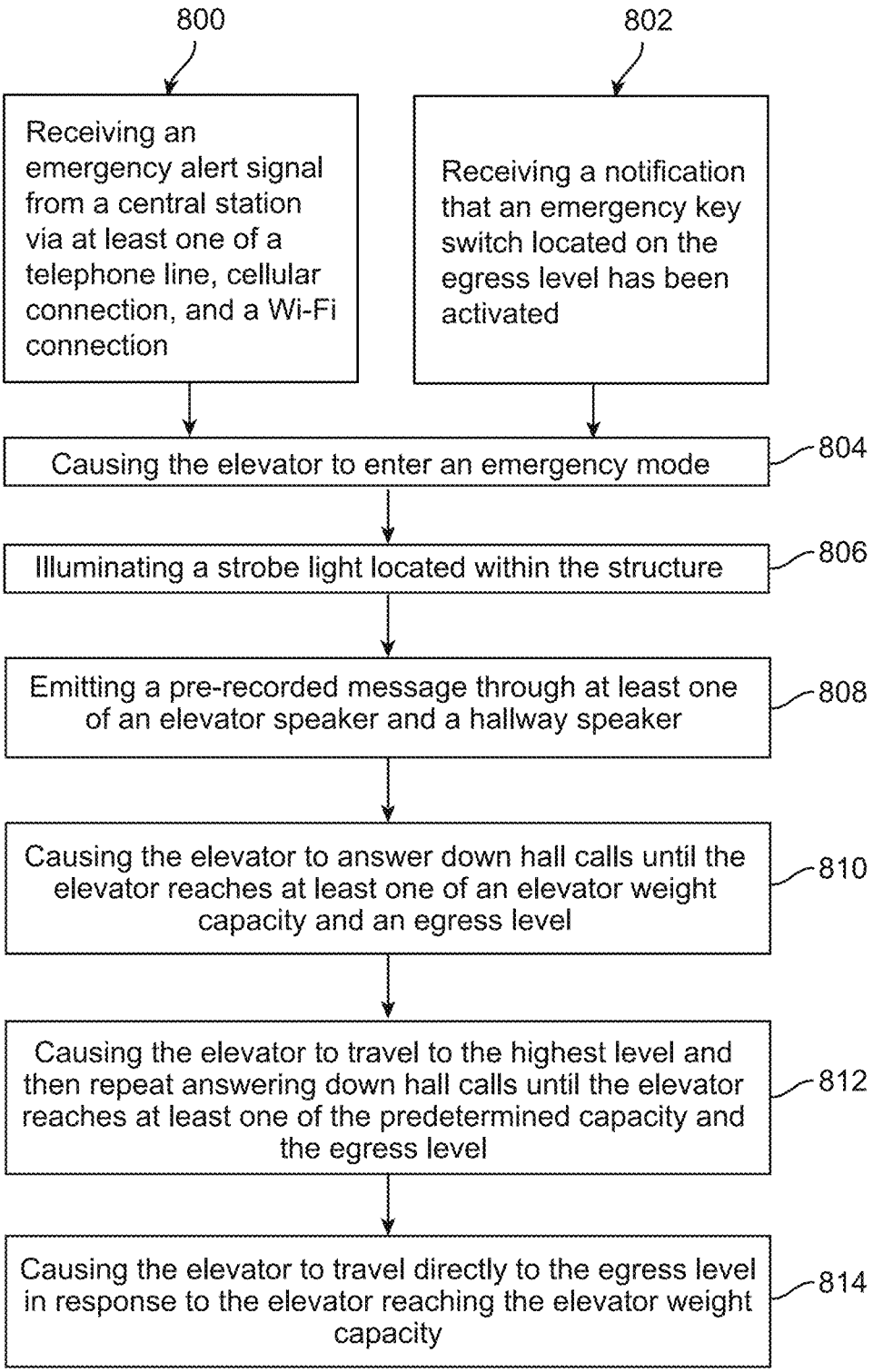

Now with reference to FIG. 8, we will now discuss specific steps performed by the system 10. The system may enter the emergency mode via inputs from a central station 19 or a key switch 24 being activated. Accordingly, the method may include receiving an emergency alert signal 18 from a central station 19 via at least one of a telephone line, cellular connection, and a Wi-Fi connection (at step 800). Alternatively, the system may enter the emergency mode via receiving a notification that an emergency key switch 24 located on the egress level has been activated (at step 802). Either input at 800 or 802 may thereby cause the elevator 1 to enter an emergency mode whereby the elevator 1 travels vertically downward with respect to the structure 12 (at step 804).

Once the elevator emergency control system 10 has entered the emergency mode, the system 10 may perform various actions to alert people in the area. Methods may thereby include illuminating a strobe light 42 located within the structure 12 (at step 806) to provide further warning to building occupants. Embodiments may also include emitting a pre-recorded message through an elevator speaker 40*a* (e.g. a speaker in the control operating panel) and/or a hallway speaker 40*b* (at step 808). Methods may also include causing the elevator 1 to answer down hall calls until the elevator 1 reaches either an elevator weight capacity or an egress floor (at step 810).

Once the elevator reaches the egress floor and allows passengers to unload, the elevator emergency control system 10 may cause the elevator 1 to travel to an uppermost floor and then repeat answering down hall calls until the elevator 1 reaches the predetermined weight capacity and/or the egress floor 22 (at step 812). In the event that the elevator 1 reaches the predetermined elevator weight capacity, the system 10 may cause the elevator 1 to travel directly to the egress floor 22 (at step 814).

Figure 9:
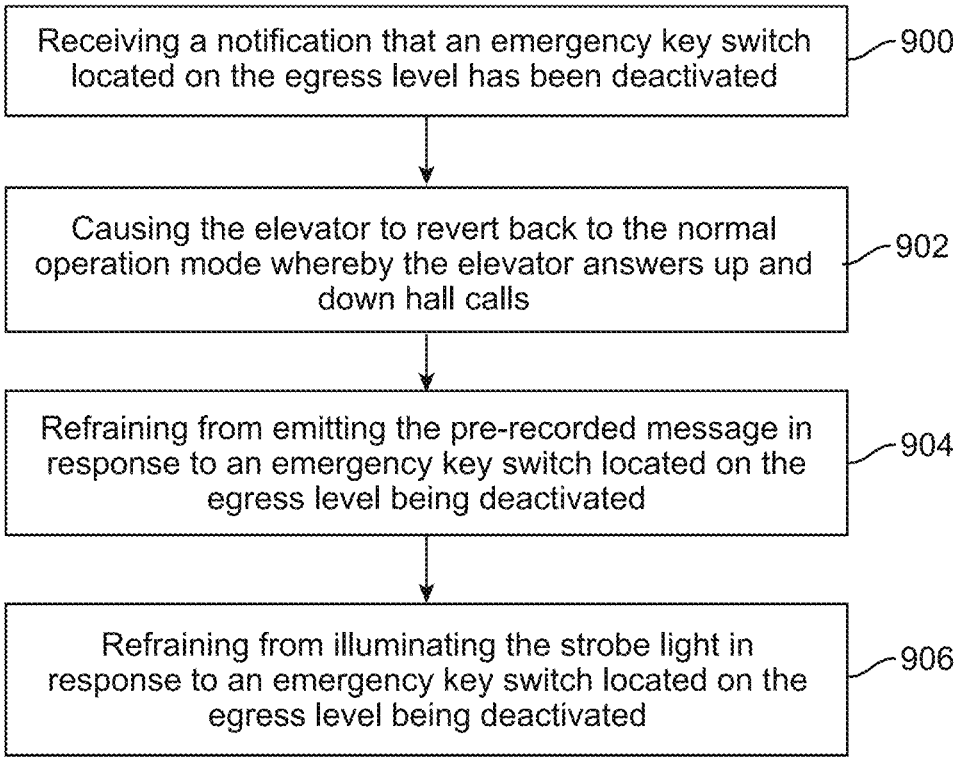

Now with reference to FIG. 9, once the emergency event has ended, the elevator emergency control system 10 may cause the elevator 1 to revert back to a normal operation mode in response to the key switch 24 being deactivated. As such, in order to revert back to the normal operation mode, methods may include receiving a notification that an emergency key switch located on the egress level has been deactivated (at step 900), which may cause the system to revert back to normal operation mode whereby the elevator answers up and down hall calls (at step 902). Once the system is back in the normal operation mode, methods may include refraining from emitting the pre-recorded message in response to an emergency key switch 24 located on the egress floor 22 being deactivated (at step 904). Furthermore, methods may include refraining from illuminating the strobe light 42 in response to the emergency key switch 24 being deactivated (at step 906).

Figure 10:
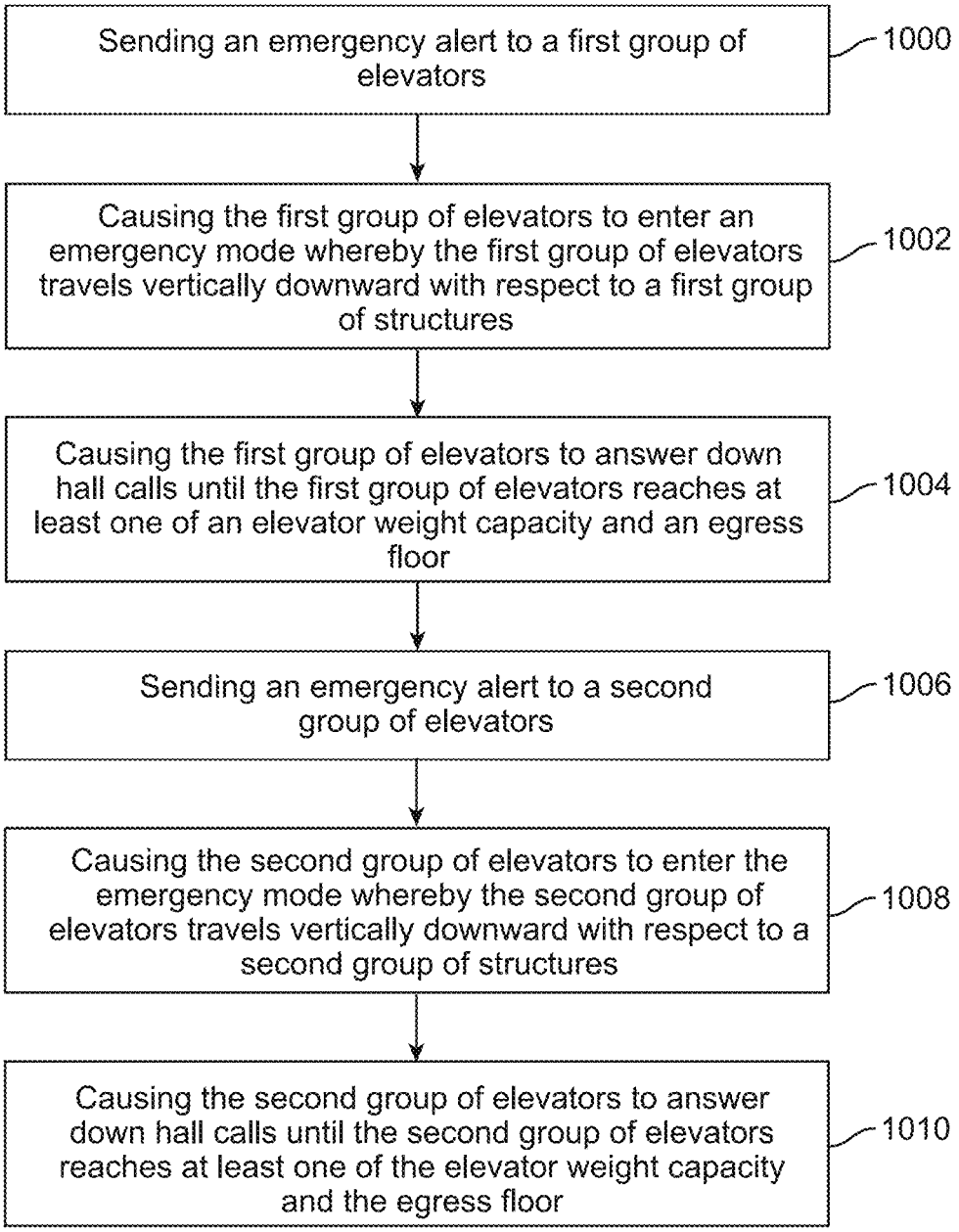

As shown in FIG. 10, methods may include sending, via a central station 19, an emergency alert to a first group of elevators (at step 1000). Methods may thereby include causing the first group of elevators to enter an emergency mode whereby the first group of elevators travels vertically downward with respect to a first group of structures (at step 1002). Methods may also include causing the first group of elevators to answer down hall calls until the first group of elevators reaches at least one of an elevator weight capacity and an egress floor (at step 1004).

Methods may also include sending an emergency alert to a second group of elevators (at step 1006). Accordingly, methods may include causing the second group of elevators to enter the emergency mode whereby the second group of elevators travels vertically downward with respect to a second group of structures (at step 1008). Additionally, methods may include causing the second group of elevators to answer down hall calls until the second group of elevators reaches at least one of the elevator weight capacity and the egress floor (at step 1010).

Figure 11:
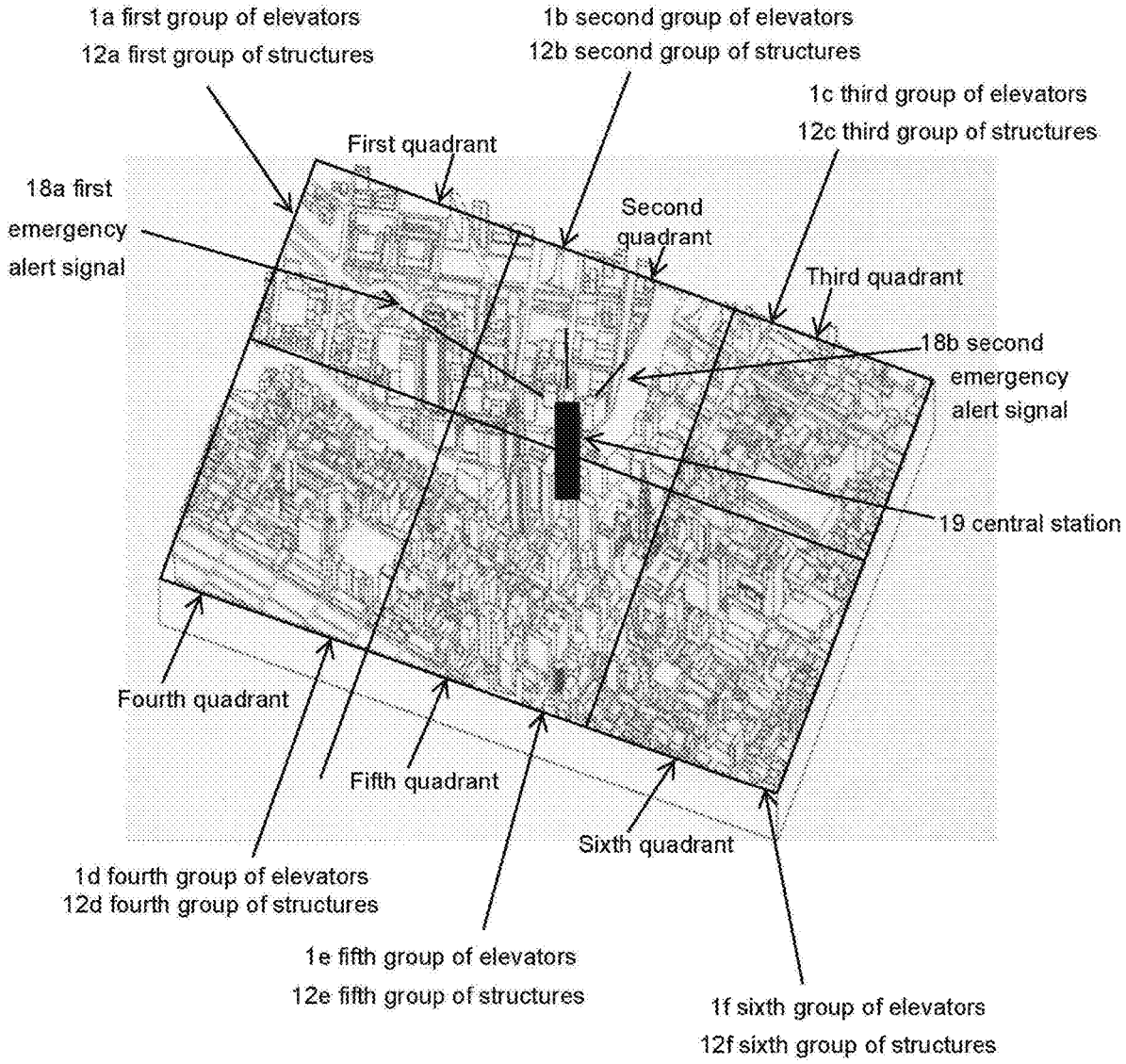
FIG. 11 illustrates a diagram of a city divided into quadrants, according to some embodiments.

As illustrated in FIG. 11, the system includes a central station 19 arranged and configured to send a first emergency alert signal 18*a* that causes a first group of elevators 1*a* to enter an emergency mode whereby the first group of elevators travel vertically downward with respect to a first group of structures 12*a* and answer down hall calls until the first group of elevators 1*a* reaches at least one of an elevator weight capacity and an egress floor. The central station 19 may also be arranged and configured to receive a second emergency alert signal 18*b* that causes a second group of elevators 1*b* to enter the emergency mode whereby the second group of elevators 1*b* travel vertically downward with respect to a second group of structures 12*b* and answer down hall calls until the second group of elevators 1*b* reach at least one of the elevator weight capacity and the egress floor. As shown in FIG. 11, the first group of structures 12*a* may be located within a first quadrant of a city (e.g., a first divided section of the city) and the second group of structures 12*b* may be located within a second quadrant of the city (e.g., a second divided section of the city).

As further illustrated in FIG. 11, the central station 19 may be arranged and configured to send emergency alert signals 18 to any number of elevators, structures, and quadrants. For example, the central station 19 may be arranged and configured to send emergency alerts to a third group of elevators 1*c* that travel vertically downward with respect to a third group of structures 12*c* located within a third quadrant of the city (e.g., a third divided section of the city), a fourth group of elevators 1*d* that travel vertically downward with respect to a fourth group of structures 12*d* located within a fourth quadrant of the city (e.g., a fourth divided section of the city), a fifth group of elevators 1*e* that travel vertically downward with respect to a fifth group of structures 12*e* located within a fifth quadrant of the city (e.g., a fifth divided section of the city), and even a sixth group of elevators 1*f* that travel vertically downward with respect to a sixth group of structures 12*f* located within a sixth quadrant of the city (e.g., a sixth divided section of the city).

Figure 12:
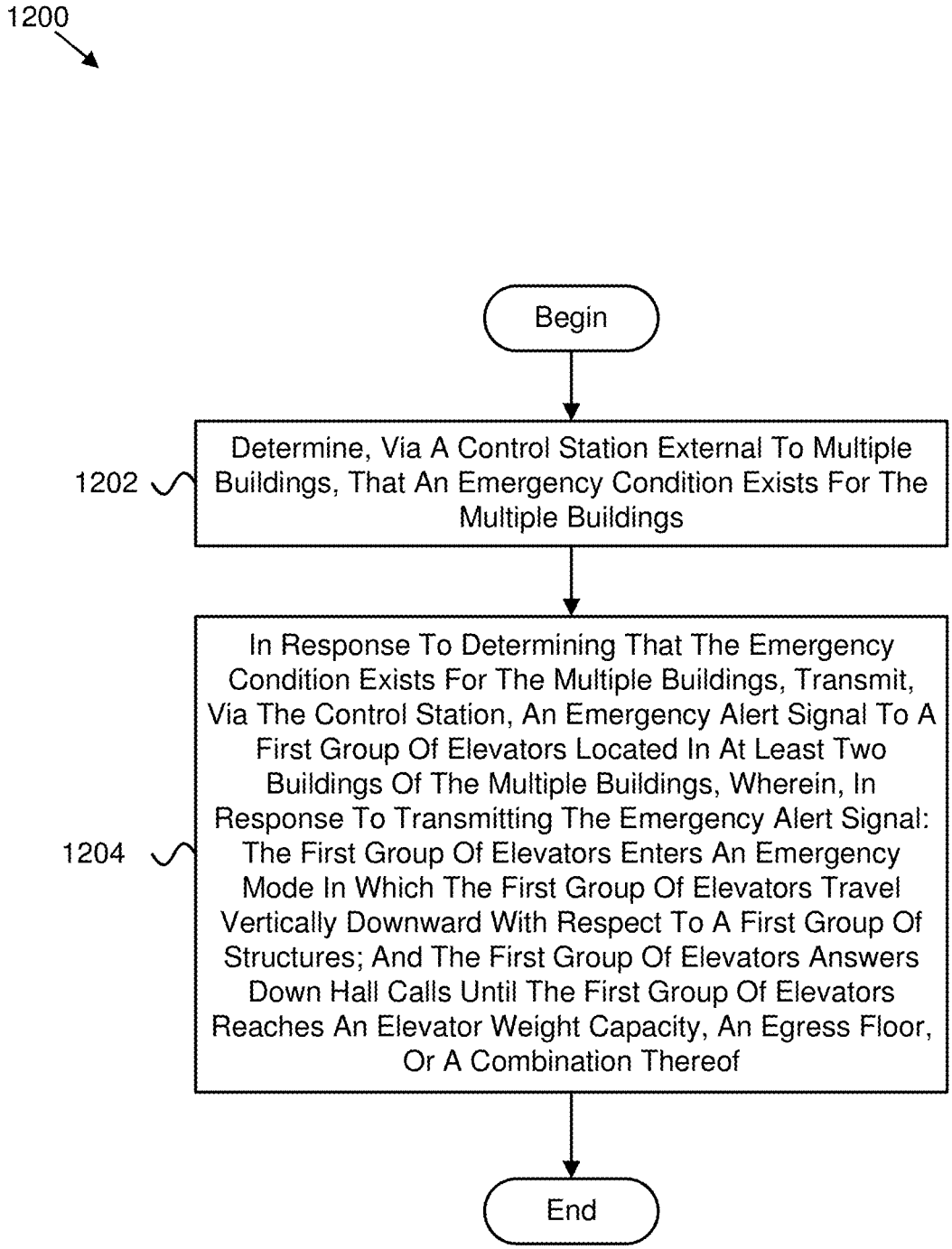
FIG. 12 is a block diagram of an embodiment of a method for transmitting an emergency alert signal.

FIG. 12 is a block diagram of an embodiment of a method 1200 for transmitting an emergency alert signal. The method 1200 may be performed by any suitable apparatus, such as the central station 19, or a control station.

In one embodiment, the method 1200 includes determining 1202, via a control station (e.g., the central station 19) external to multiple buildings, that an emergency condition exists for the multiple buildings. In some embodiments, the method 1200 includes, in response to determining that the emergency condition exists for the multiple buildings, transmitting 1204, via the control station, an emergency alert signal to a first group of elevators located in at least two buildings of the multiple buildings. In such embodiments, in response to transmitting the emergency alert signal: the first group of elevators enters an emergency mode in which the first group of elevators travel vertically downward with respect to a first group of structures; and the first group of elevators answers down hall calls until the first group of elevators reaches an elevator weight capacity, an egress floor, or a combination thereof.

In certain embodiments, the method 1200 includes, in response to transmitting the emergency alert signal, the first group of elevators travels to an uppermost floor of the first group of structures and then answers the down hall calls until the first group of elevators reaches the elevator weight capacity, the egress floor, or a combination thereof. In various embodiments, in response to transmitting the emergency alert signal, the first group of elevators travels directly to the egress floor of the first group of structures in response to the first group of elevators reaching the elevator weight capacity. In some embodiments, the method 1200 includes receiving a signal that indicates that the emergency condition no longer exists in response to one or more groups of emergency key switches deactivating the emergency mode in the first group of elevators.

In one embodiment, the method 1200 includes transmitting, via the control station, the emergency alert signal to a second group of elevators located in at least two buildings of the multiple buildings. In such an embodiment, the second group of elevators is different from the first group of elevators, and transmitting the emergency alert signal to the second group of elevators directs: the second group of elevators to enter the emergency mode in which the second group of elevators travel vertically downward with respect to a second group of structures; and the second group of elevators to answer down hall calls until the second group of elevators reaches the elevator weight capacity, the egress floor, or a combination thereof. In certain embodiments, the first group of structures are located within a first quadrant of a city and the second group of structures are located within a second quadrant of the city.

In various embodiments, one or more groups of emergency key switches are communicatively coupled to the first group of elevators, and the one or more groups of emergency key switches are configured to activate and deactivate the emergency mode in the first group of elevators. In some embodiments, the code is configured to receive information indicating that the emergency condition exists. In certain embodiments, the code is configured to receive information indicating that the emergency condition no longer exists. In one embodiment, the code is configured to receive information indicating that the emergency condition no longer exists in response to one or more groups of emergency key switches deactivating the emergency mode in the first group of elevators.

In various embodiments, the first group of structures are taller than a first predetermined height and the second group of structures are shorter than the first predetermined height. In one embodiment, the emergency mode does not change operation of the first group of elevators if the first group of elevators are in an earthquake response mode.

Figure 13:
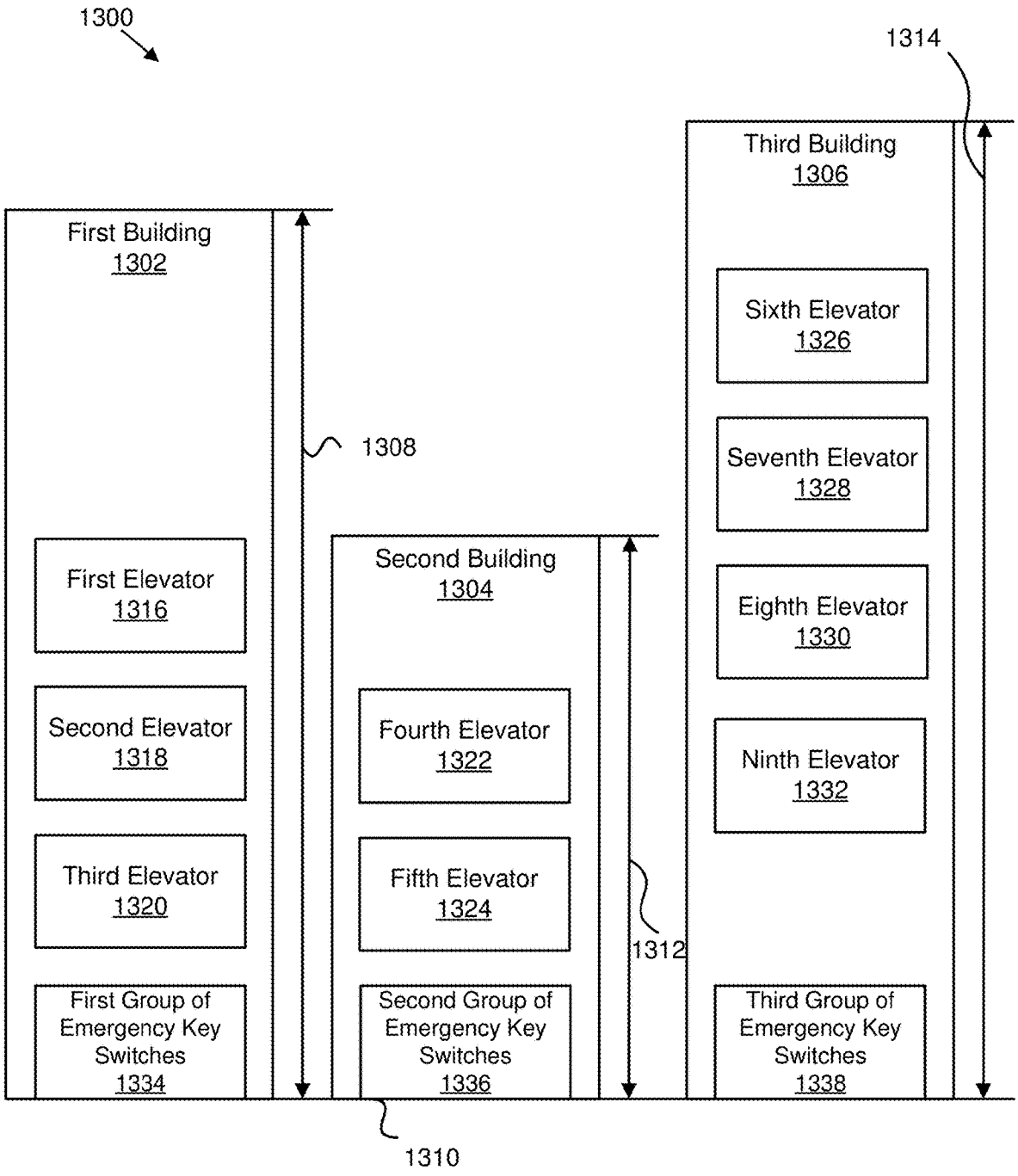
FIG. 13 is a block diagram of an embodiment of a first group of buildings in a first quadrant.

FIG. 13 is a block diagram of an embodiment of a first group of buildings 1300 (e.g., structures) in a first quadrant of a city. The first group of buildings 1300 includes a first building 1302, a second building 1304, and a third building 1306. In other embodiments, the first group of buildings 1300 may include fewer or more buildings.

The first building 1302 has a first height 1308 from a ground 1310 to a top of the first building 1302. Moreover, the second building 1304 has a second height 1312 from the ground 1310 to a top of the second building 1304. Furthermore, the third building 1306 has a third height 1314 from the ground 1310 to a top of the third building 1306. As illustrated, the first height 1308 may be greater than the second height 1312. In addition, the second height 1312 may be less than the third height 1314. Furthermore, the third height 1314 may be greater than the first height 1308.

The first building 1302 includes a first elevator 1316, a second elevator 1318, and a third elevator 1320. The second building 1304 includes a fourth elevator 1322 and a fifth elevator 1324. Moreover, the third building 1306 includes a sixth elevator 1326, a seventh elevator 1328, an eighth elevator 1330, and a ninth elevator 1332. As may be appreciated, any of the first building 1302, the second building 1304, and the third building 1306 may include fewer or more elevators. A first group of emergency key switches 1334 is communicatively coupled to the first elevator 1316, the second elevator 1318, and the third elevator 1320 in the first building 1302 and may be used to activate and/or deactivate an emergency mode in the first elevator 1316, the second elevator 1318, and the third elevator 1320. A second group of emergency key switches 1336 is communicatively coupled to the fourth elevator 1322 and the fifth elevator 1324 in the second building 1304 and may be used to activate and/or deactivate an emergency mode in the fourth elevator 1322 and the fifth elevator 1324. A third group of emergency key switches 1338 is communicatively coupled to the sixth elevator 1326, the seventh elevator 1328, the eighth elevator 1330, and the ninth elevator 1332 in the third building 1306 and may be used to activate and/or deactivate an emergency mode in the sixth elevator 1326, the seventh elevator 1328, the eighth elevator 1330, and the ninth elevator 1332. As may be appreciated, each of the first group of buildings 1300 may be taller than a first predetermined height (e.g., 30 feet).

Figure 14:
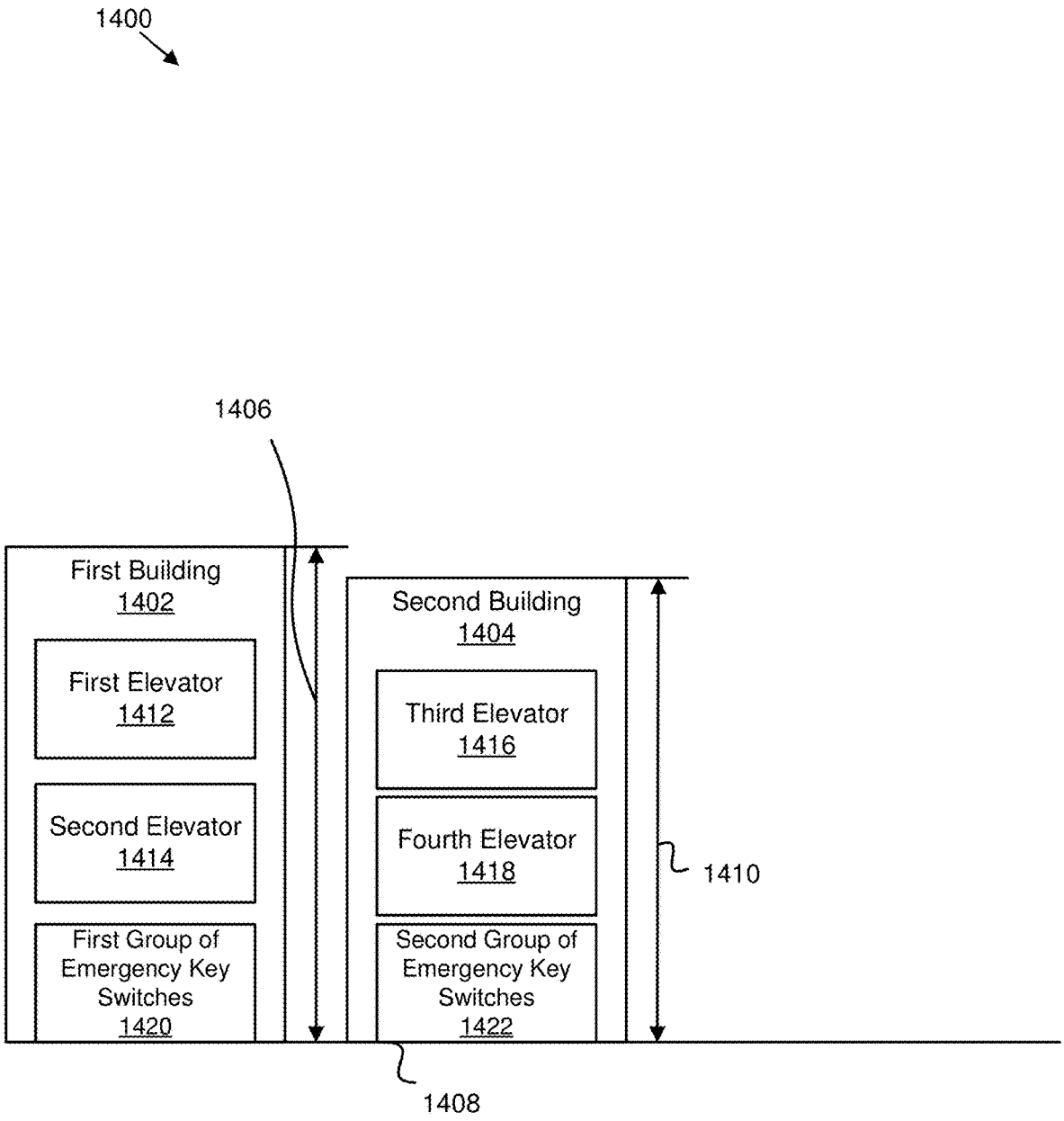
FIG. 14 is a block diagram of an embodiment of a second group of buildings in a second quadrant.

FIG. 14 is a block diagram of an embodiment of a second group of buildings 1400 (e.g., structures) in a second quadrant of a city. The second group of buildings 1400 includes a first building 1402 and a second building 1404. In other embodiments, the second group of buildings 1400 may include fewer or more buildings.

The first building 1402 has a first height 1406 from a ground 1408 to a top of the first building 1402. Moreover, the second building 1404 has a second height 1410 from the ground 1408 to a top of the second building 1404. As illustrated, the first height 1406 may be greater than the second height 1410.

The first building 1402 includes a first elevator 1412 and a second elevator 1414. The second building 1404 includes a third elevator 1416 and a fourth elevator 1418. As may be appreciated, any of the first building 1402 and the second building 1404 may include fewer or more elevators. A first group of emergency key switches 1420 is communicatively coupled to the first elevator 1412 and the second elevator 1414 in the first building 1402 and may be used to activate and/or deactivate an emergency mode in the first elevator 1412 and the second elevator 1414. A second group of emergency key switches 1422 is communicatively coupled to the third elevator 1416 and the fourth elevator 1418 in the second building 1404 and may be used to activate and/or deactivate an emergency mode in the third elevator 1416 and the fourth elevator 1418. As may be appreciated, each of the second group of buildings 1400 may be shorter than a first predetermined height (e.g., 30 feet) and/or may be shorter than the first group of buildings 1300 illustrated in FIG. 13.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The invention claimed is:

1. An elevator emergency control system comprising:

a control station disposed external to a plurality of buildings, wherein the control station is configured to:

determine that an emergency condition exists for the plurality of buildings;

in response to determining that the emergency condition exists for the plurality of buildings, transmit a first emergency alert signal that directs a first group of elevators located in at least two buildings of the plurality of building to enter an emergency mode, and the emergency mode results in the first group of elevators:

traveling vertically downward with respect to a first group of structures; and answering down hall calls until the first group of elevators reaches an elevator weight capacity, an egress floor, or a combination thereof; and transmit a second emergency alert signal that directs a second group of elevators located in at least two buildings of the plurality of buildings to enter the emergency mode, the second group of elevators is different from the first group of elevators, and the emergency mode results in the second group of elevators:

traveling vertically downward with respect to a second group of structures; and answering down hall calls until the second group of elevators reaches the elevator weight capacity, the egress floor, or a combination thereof.

2. The elevator emergency control system of claim 1, wherein one or more groups of emergency key switches are communicatively coupled to the first group of elevators, and the one or more groups of emergency key switches are configured to activate and deactivate the emergency mode in the first group of elevators.

3. The elevator emergency control system of claim 1, wherein the control station is configured to receive information indicating that the emergency condition exists.

4. The elevator emergency control system of claim 1, wherein the control station is configured to receive information indicating that the emergency condition no longer exists.

5. The elevator emergency control system of claim 4, wherein the control station is configured to receive the information indicating that the emergency condition no longer exists in response to one or more groups of emergency key switches deactivating the emergency mode in the first group of elevators.

6. The elevator emergency control system of claim 1, wherein the first group of structures are located within a first quadrant of a city and the second group of structures are located within a second quadrant of the city.

7. The elevator emergency control system of claim 1, wherein the first group of structures are taller than a first predetermined height and the second group of structures are shorter than the first predetermined height.

8. The elevator emergency control system of claim 1, wherein the emergency mode does not change operation of the first group of elevators if the first group of elevators are in an earthquake response mode.

9. A method comprising:

determining, via a control station external to a plurality of buildings, that an emergency condition exists for the plurality of buildings;

in response to determining that the emergency condition exists for the plurality of buildings, transmitting, via the control station, an emergency alert signal to a first group of elevators located in at least two buildings of the plurality of buildings, wherein, in response to transmitting the emergency alert signal:

the first group of elevators enters an emergency mode in which the first group of elevators travel vertically downward with respect to a first group of structures; and the first group of elevators answers down hall calls until the first group of elevators reaches an elevator weight capacity, an egress floor, or a combination thereof; and transmitting, via the control station, the emergency alert signal to a second group of elevators located in at least two buildings of the plurality of buildings, wherein the second group of elevators is different from the first group of elevators, and transmitting the emergency alert signal to the second group of elevators directs:

the second group of elevators to enter the emergency mode in which the second group of elevators travel vertically downward with respect to a second group of structures; and the second group of elevators to answer down hall calls until the second group of elevators reaches the elevator weight capacity, the egress floor, or a combination thereof.

10. The method of claim 9, wherein, in response to transmitting the emergency alert signal, the first group of elevators travels to an uppermost floor of the first group of structures and then answers the down hall calls until the first group of elevators reaches the elevator weight capacity, the egress floor, or a combination thereof.

11. The method of claim 9, wherein, in response to transmitting the emergency alert signal, the first group of elevators travels directly to the egress floor of the first group of structures in response to the first group of elevators reaching the elevator weight capacity.

12. The method of claim 9, further comprising receiving a signal that indicates that the emergency condition no longer exists in response to one or more groups of emergency key switches deactivating the emergency mode in the first group of elevators.

13. The method of claim 9, wherein the first group of structures are located within a first quadrant of a city and the second group of structures are located within a second quadrant of the city.

14. An apparatus comprising:

a processor;

a memory comprising code executable by the processor, wherein the code is configured to:

determine that an emergency condition exists for a plurality of buildings external to the apparatus;

in response to determining that the emergency condition exists for the plurality of buildings, transmit a first emergency alert signal that directs a first group of elevators located in at least two buildings of the plurality of buildings to enter an emergency mode, and the emergency mode results in the first group of elevators:

traveling vertically downward with respect to a first group of structures; and answering down hall calls until the first group of elevators reaches an elevator weight capacity, an egress floor, or a combination thereof; and transmit a second emergency alert signal that directs a second group of elevators located in at least two buildings of the plurality of buildings to enter the emergency mode, the second group of elevators is different from the first group of elevators, and the emergency mode results in the second group of elevators:

traveling vertically downward with respect to a second group of structures; and answering down hall calls until the second group of elevators reaches the elevator weight capacity, the egress floor, or a combination thereof.

15. The apparatus of claim 14, wherein one or more groups of emergency key switches are communicatively coupled to the first group of elevators, and the one or more groups of emergency key switches are configured to activate and deactivate the emergency mode in the first group of elevators.

16. The apparatus of claim 14, wherein the code is configured to receive information indicating that the emergency condition exists.

17. The apparatus of claim 14, wherein the code is configured to receive information indicating that the emergency condition no longer exists.

18. The apparatus of claim 14, wherein the code is configured to receive information indicating that the emergency condition no longer exists in response to one or more groups of emergency key switches deactivating the emergency mode in the first group of elevators.

* * * * *